US008366452B2

(12) United States Patent
Yeh

(10) Patent No.: US 8,366,452 B2
(45) Date of Patent: Feb. 5, 2013

(54) LOW PROFILE SOCKET CONNECTOR WITH IMPROVED CONTACTS

(75) Inventor: Cheng-Chi Yeh, New Taipei (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/032,646

(22) Filed: Feb. 23, 2011

(65) Prior Publication Data

US 2011/0250794 A1 Oct. 13, 2011

(30) Foreign Application Priority Data

Apr. 9, 2010 (TW) ..... 99206347

(51) Int. Cl.
*H01R 12/00* (2006.01)

(52) U.S. Cl. ..... 439/66; 439/91; 439/83; 439/885

(58) Field of Classification Search ..... 439/66, 439/91, 83, 885, 862
See application file for complete search history.

(56) References Cited

U.S. PATENT DOCUMENTS

| | | | | |
|---|---|---|---|---|
| 5,199,889 | A * | 4/1993 | McDevitt, Jr. | 439/66 |
| 6,501,665 | B1 | 12/2002 | Ted | |
| 6,533,591 | B1 * | 3/2003 | Lee | 439/83 |
| 6,887,114 | B2 | 5/2005 | Liao | |
| 7,753,736 | B2 * | 7/2010 | Yang et al. | 439/638 |
| 2005/0009385 | A1 * | 1/2005 | Korsunsky et al. | 439/83 |
| 2010/0035445 | A1 * | 2/2010 | Zhang | 439/66 |

* cited by examiner

*Primary Examiner* — Gary F. Paumen
(74) *Attorney, Agent, or Firm* — Wei Te Chung; Ming Chieh Chang

(57) ABSTRACT

A socket connector includes an insulative housing with a plurality of receiving holes, and a plurality of contacts received in the receiving holes. The contact has a soldering portion, and a retaining arm and a resilient arm respectively extending upwardly from the soldering portion. The retaining arm has a broken edge facing downward, which is formed by breaking a carrier from the contact.

15 Claims, 3 Drawing Sheets

LOW PROFILE SOCKET CONNECTOR WITH IMPROVED CONTACTS

BACKGROUND OF THE INVENTION

1. Field of the Invention

The present invention relates to a socket connector, and more particularly to a low profile socket connector having improved contacts with a side-by-side arrangement of two arms.

2. Description of Related Art

An IC package, such as a CPU (Central Processing Unit), is generally coupled with a system via a socket connector mounted on a PCB (Printed Circuit Board). A type of LGA (Land Grid Array) socket connector is disclosed by U.S. Pat. No. 6,887,114 issued to Liao, on May 3, 2005, which is suitable to connect an IC package having a plurality of conductive pads at a bottom surface thereof The socket connector includes an insulative housing and a plurality of contacts received in the housing. Each contact includes a soldering pad located at a bottom position, a retaining portion extending upwardly from the soldering pad, and a contacting arm further extending upwardly from the retaining portion. The contact is securely retained in the housing by a pair of barbs located at opposite sides of the retaining portion. However, the contact has a relatively large height, and doesn't meet the trend of miniaturization of electronic device.

In view of the above, a low profile socket connector is desired.

SUMMARY OF THE INVENTION

Accordingly, an object of the present invention is to provide a low profile socket connector utilizing improved contacts.

To achieve above object, a socket connector is provided, which includes an insulative housing with a plurality of receiving holes, and a plurality of contacts received in the receiving holes. The contact has a soldering portion, and a retaining arm and a resilient arm respectively extending upwardly from the soldering portion. The retaining arm has a broken edge facing downward, which is formed by breaking a carrier from the contact.

The object is also achieved by a socket connector which includes an insulative housing with a plurality of receiving holes, and a plurality of contacts received in the receiving holes. The contact has a soldering portion, and a retaining arm and a resilient arm respectively extending upwardly from the soldering portion. The resilient arm comprises an elastic portion extending toward the retaining arm and a contacting portion extending from the elastic portion and away from the retaining arm so that the contact is formed with a substantially S-shaped structure.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
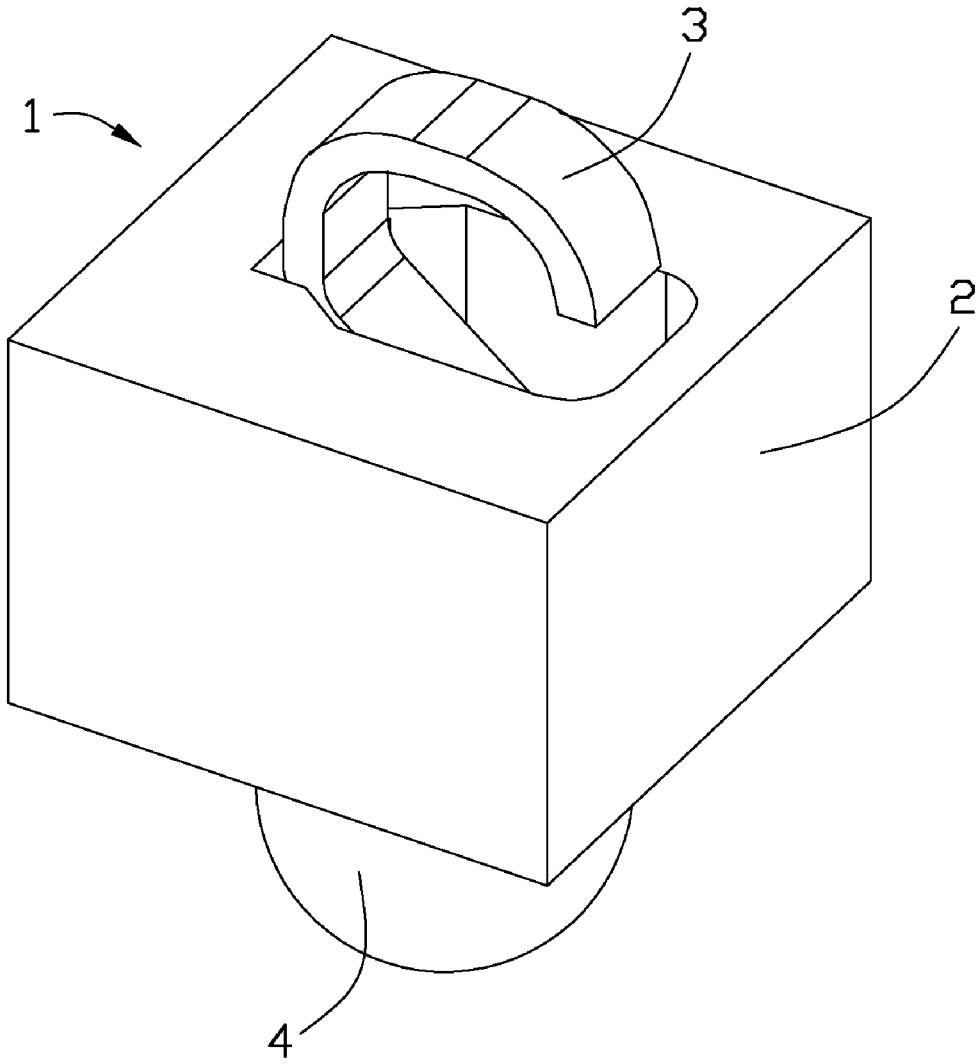
FIG. 1 is an assembled, perspective view of a socket connector in accordance with a preferred embodiment of the present invention.
Figure 2:
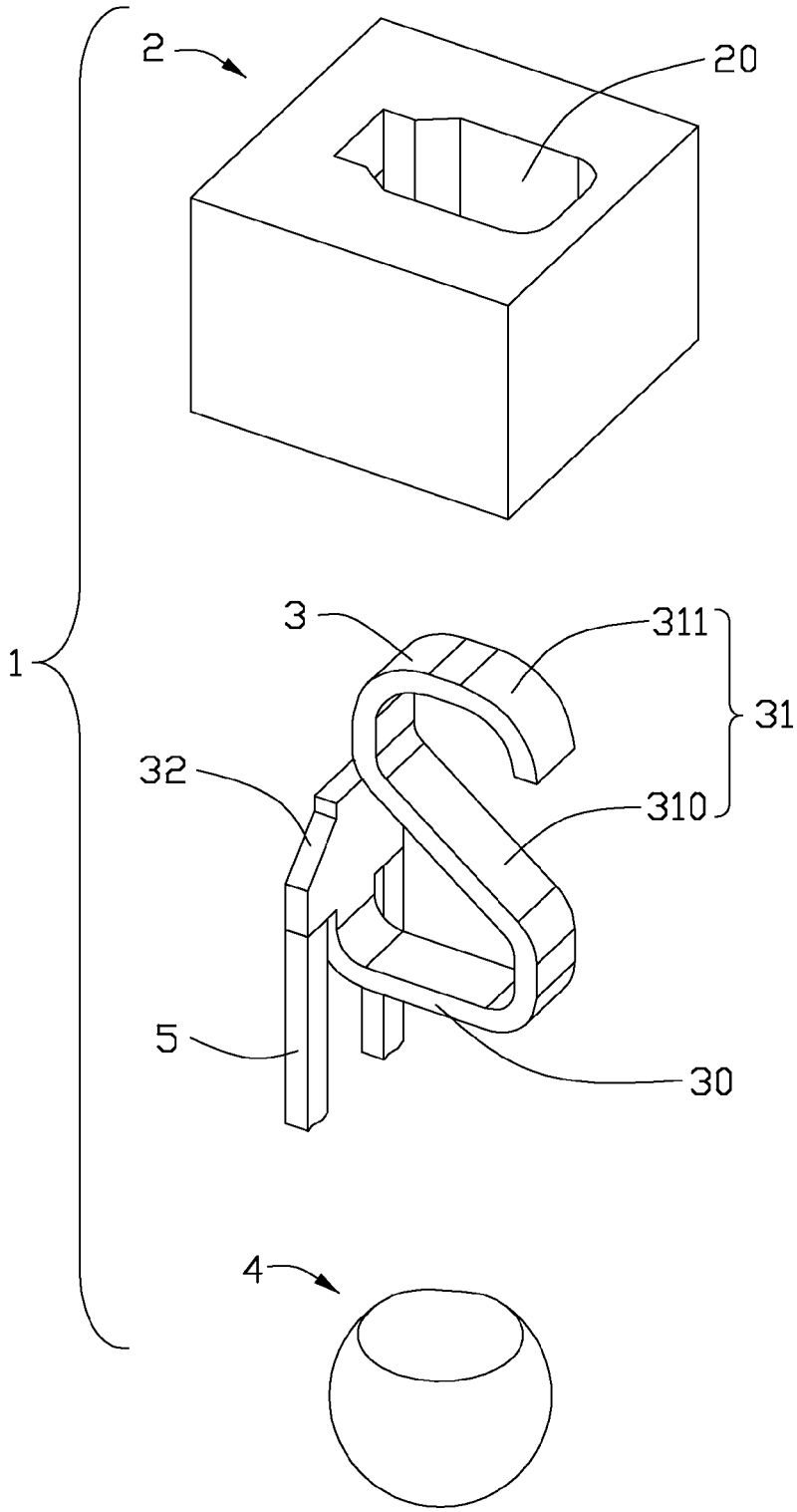
FIG. 2 is an exploded, perspective view of the socket connector shown in FIG. 1, wherein a carrier is connected to a contact.
Figure 3:
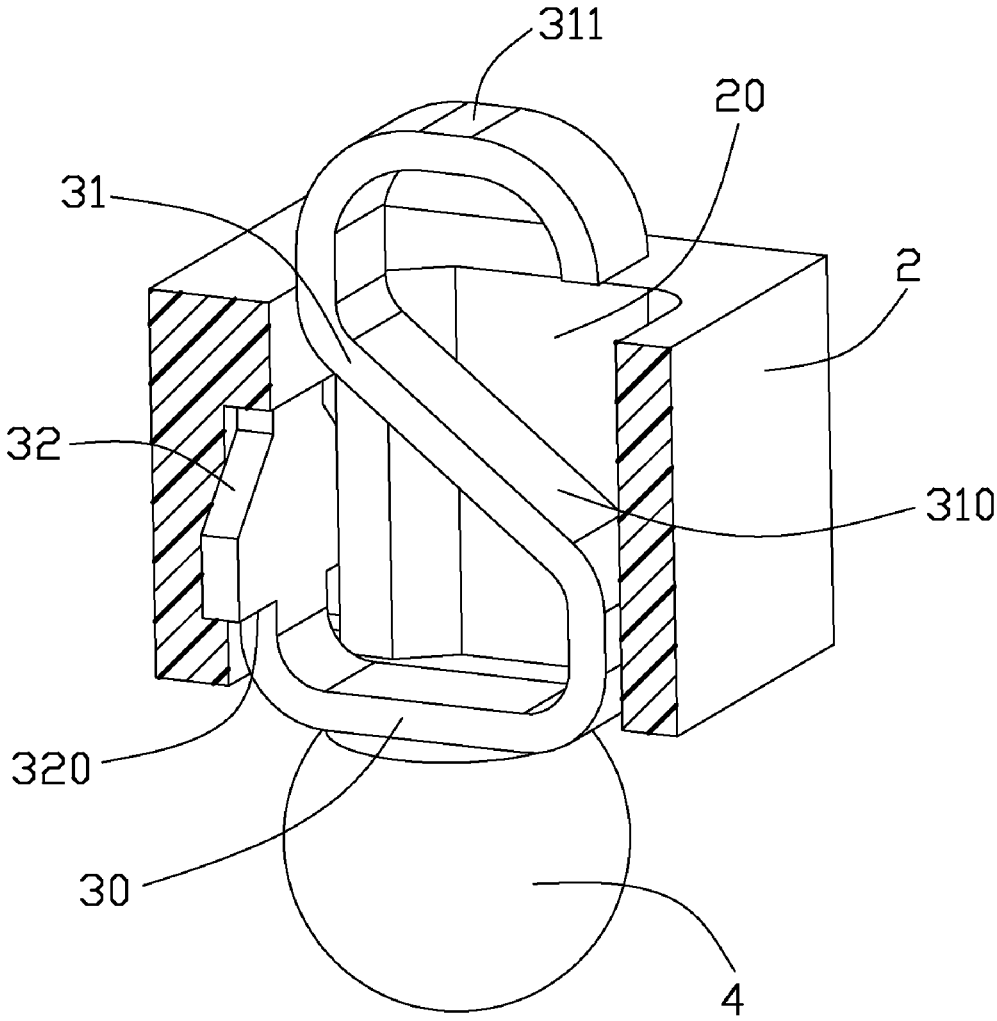
FIG. 3 is a cross-sectional view of the socket connector, particularly illustrating a contact received in an insulative housing.

Referring to FIGS. 1 to 3, a socket connector 1 made in accordance with the present invention includes an insulative housing 2 with a plurality of receiving holes 20 formed therein and a plurality of contacts 3 respectively received in the insulative housing 2 (only one receiving hole 20 and contact 3 are shown in figures). A plurality of solder balls 4 are attached to the bottom positions of the contacts 3, respectively.

The contact 3 includes a horizontal soldering portion 30, and a resilient arm 31 and a retaining arm 32 respectively extending upwardly from opposite sides of the soldering portion 30. The solder ball 4 is attached to the bottom of the soldering portion 30. The resilient arm 31 further includes an elastic portion 310 extending toward the retaining arm 32 and a contacting portion 311 extending from the elastic portion 310 and away from the retaining arm 32 so that the contact 3 is formed with a substantial S-shaped structure. The whole resilient arm 31 doesn't interfere with an imaginary vertical plane defined by the retaining arm 32. When an IC package (not shown) is mounted on the socket connector 1, the IC package pushes the contact 3 downward so that the contact 3 undergoes elastic deformation. The conductive pads (not shown) of the IC package and the contact 3 are thereby electrically interconnected to each other. The retaining arm 32 engages the receiving hole 20 so as to have the contact 3 reliably secured in the receiving hole 20.

Before mounted to the insulative housing 2, each contact 3 is connected to two carriers 5 that located at opposite sides of the soldering portion 30 and connected to the retaining arm 32 of the contact 3. The contact 3 along with the carriers 5 is inserted to the receiving hole 20 of the housing 2 from bottom. When the insertion process is completed, the carriers 5 could be broken from the contact 3, and a pair of broken edges 32 are therefore formed at the bottom of the retaining arm 32 and face downward.

Compared to conventional stack arrangement, the side-by-side arrangement of the retaining arm 32 and the resilient arm 31 according to the present invention, achieves a relatively lower profile and thus meets the trend of miniaturization of electronic device.

The soldering portion 30 and the resilient arm 31 have equal widths and are simultaneously disposed between the two parallel carriers 5 before a bending process. So it is convenient for the design of the contact and the carrier and is saving of metal material.

In addition, the resilient arm 31 is configured to have the elastic portion 310 be fully hidden in the receiving hole 20 so that the total height of the socket connector 1 is further reduced.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. A socket connector, comprising:

an insulative housing with a plurality of receiving holes, and a plurality of contacts received in the receiving holes, the contact having a soldering portion, and a retaining arm and a resilient arm respectively extending upwardly from two opposite sides of the soldering portion, the retaining arm having a broken edge facing downward, which is formed by breaking a carrier from the contact.

2. The socket connector as claimed in claim 1, wherein the resilient arm comprises an elastic portion extending toward the retaining arm and a contacting portion extending from the elastic portion and away from the retaining arm.

3. The socket connector as claimed in claim 2, wherein the elastic portion does not interfere with an imaginary vertical plane defined by the retaining arm.

4. The socket connector as claimed in claim 2, wherein the elastic portion is fully hidden in the receiving hole.

5. The socket connector as claimed in claim 1, wherein the soldering portion and the resilient arm have equal widths and are disposed between a pair of parallel carriers before a bending process.

6. A socket connector, comprising:

an insulative housing with a plurality of receiving holes; and a plurality of contacts received in the receiving holes, the contact having a soldering portion, and a retaining arm and a resilient arm respectively extending upwardly and directly from two opposite ends of the soldering portion, the resilient arm comprising an elastic portion extending toward the retaining arm and a contacting portion extending from the elastic portion and away from the retaining arm so that the contact is formed with a substantially S-shaped structure.

7. The socket connector as claimed in claim 6, wherein the retaining arm has a broken edge facing downward, which is formed by breaking a carrier from the contact.

8. The socket connector as claimed in claim 6, wherein the elastic portion is fully hidden in the receiving hole.

9. The socket connector as claimed in claim 6, wherein the soldering portion and the resilient arm have equal widths and are disposed between a pair of parallel carriers before a bending process.

10. A socket connector comprising:

an insulative housing defining at least one passageway extending therethough in a vertical direction between opposite upper and bottom surface thereof; and at least one contact disposed in said passageway, said contact defining a vertically extending retention arm essentially butting against the housing, a soldering portion extending from a bottom portion of the retention arm and defining a horizontal area, a solder ball attached to an underside of the horizontal area, an elastic portion extending from the soldering portion opposite to said retention arm while successively toward and above the retention arm, and a contacting portion extending from a top end of the elastic portion and away from the retention arm; wherein the contacting portion extends above said upper surface of the housing while the solder ball extends below said bottom surface.

11. The socket connector as claimed in claim 10, wherein the passageways defines a wider section and a narrow section in a top view, and a joint of the contacting portion and the elastic portion is located in the narrowed section.

12. The socket connector as claimed in claim 10, wherein the housing defines a step structure against which an upper end of the retention arm confronts.

13. The socket connector as claimed in claim 12, wherein the contact and the passageway are configured to allow the contact to be inserted into the passageway only in an upward direction.

14. The socket connector as claimed in claim 10, wherein a joint between the contacting portion and the elastic portion is located offset from the retention arm in a top view.

15. The socket connector as claimed in claim 10, wherein the elastic portion defines an oblique extending section between an upper joint with the contacting portion and a lower joint with the soldering portion.

* * * * *